US008640407B2

(12) United States Patent
Alsayed et al.

(10) Patent No.: US 8,640,407 B2
(45) Date of Patent: Feb. 4, 2014

(54) MASONRY BUILDING BLOCK AND INTERLOCKING WALL SYSTEM INCORPORATING SUCH BLOCKS

(75) Inventors: Saleh H. Alsayed, Riyadh (SA); Husain Abbas, Riyadh (SA); Yousef A. Al-Salloum, Riyadh (SA); Mohammed S. Alhaddad, Riyadh (SA)

(73) Assignee: King Saud University, Riyadh (SA)

( * ) Notice: Subject to any disclaimer, the term of this patent is extended or adjusted under 35 U.S.C. 154(b) by 0 days.

(21) Appl. No.: 13/495,249

(22) Filed: Jun. 13, 2012

(65) Prior Publication Data

US 2013/0333313 A1 Dec. 19, 2013

(51) Int. Cl.
*E04C 2/52* (2006.01)

(52) U.S. Cl.
USPC ..... 52/220.1; 52/220.3; 52/505; 52/592.5; 52/592.6

(58) Field of Classification Search
USPC ..... 52/220.1, 220.3, 505, 592.1, 592.3, 52/592.4, 592.5, 595.6, 596, 604, 606, 52/607, 59.6
See application file for complete search history.

(56) References Cited

U.S. PATENT DOCUMENTS

| | | | |
|---|---|---|---|
| 3,534,518 | A | 10/1970 | Zagray |
| 4,075,808 | A | 2/1978 | Pearlman |
| 5,355,647 | A | 10/1994 | Johnson et al. |
| 5,899,040 | A | 5/1999 | Cerrato |
| 6,105,330 | A | 8/2000 | Nanayakkara |
| 6,244,009 | B1 | 6/2001 | Cerrato |
| 6,758,020 | B2 | 7/2004 | Cerrato |

FOREIGN PATENT DOCUMENTS

| | | |
|---|---|---|
| DE | 197 14 626 A1 | 10/1997 |
| FR | 2 329 819 | 7/1977 |
| FR | 2 773 570 | 7/1999 |
| RU | 2 087 637 C1 | 8/1997 |

*Primary Examiner* — James Buckle, Jr.

(74) *Attorney, Agent, or Firm* — Lowe Hauptman & Ham, LLP

(57) ABSTRACT

A rectangular shaped interlocking building block comprises a pair of exterior sides and an upper and a lower longitudinally extending horizontal faces and a pair of opposite vertical ends and wherein said building blocks include a pair of side members and wherein each of said side members includes a vertically extending exterior rib on an inner side thereof; a generally rectangular intermediate section is disposed between said side members in an abutting relationship and wherein the intermediate section defines a rectangular shaped vertical recess between the side members and a recess that extends between a bottom of one of said side members and the top of an adjacent block. The rectangular rib and vertical recesses are constructed and dimensioned so that one rib fits loosely but closely within the recess and the intermediate section includes a pair of elliptical shaped vertical passageways.

7 Claims, 6 Drawing Sheets

MASONRY BUILDING BLOCK AND INTERLOCKING WALL SYSTEM INCORPORATING SUCH BLOCKS

FIELD OF THE INVENTION

This invention relates to masonry building blocks and interlocking wall systems incorporating such blocks. More particularly, the invention relates to a generally rectangular shaped block having a pair of recesses and a pair of extensions therein for locking the blocks together into a wall structure. The blocks also have provision for grouting with or without rebars and for concealed utilities in horizontal as well as vertical directions. The invention also relates to end closing blocks of half and full sizes.

BACKGROUND FOR THE INVENTION

A variety of interlocking type masonry building blocks are available for the construction of load bearing and non-load bearing walls. Such blocks are laid in courses without the use of mortar as done in conventional masonry. As a general rule, conventional masonry wall blocks are heavy and relatively difficult to handle. Such blocks typically include projections that mate with corresponding indentations on adjacent blocks. However, many of these projections are relatively small and thus there is an inherent weakness in the block. Also the use of small projections and small indentations means that the blocks have to be built to close tolerances which makes the blocks more expensive. The typical small projections may be easily broken or chipped off prior to or during construction which means that many blocks are discarded adding to the expense. Further the available blocks do not have suitable provision for the installation of embedded utilities. Thus there is a need for masonry wall blocks that are relatively light and easier to handle, that are cost effective to manufacture and easily assembled into a more stable and dependable wall structure with provisions for embedding utilities.

An early example of typical approaches to an interlocking block wall is disclosed in a U.S. Pat. No. 3,382,632 of Grafsik. As disclosed therein a block construction wherein a plurality of blocks are assembled together by means of cooperating projections and cavities formed in the blocks and suitable tie rods screw the blocks together under vertical tension to provide a sturdy wall construction. The tie rods extend transversely through vertical passages in each block and are adapted to be engaged by the tie rods for securing layers of the blocks together in vertical tension.

A more recent U.S. Pat. No. 6,105,330 of Nanayakkara discloses a construction component for use in a wall structure. The component is capable of resisting high gravity and lateral loads and is defined by a partially hollow building block having a generally solid rectangular exterior configuration in which one entire end surface of the building block exhibits a positive deep key geometry and the opposing end surface exhibits a negative deep key geometry complement to the positive geometry of the opposite end. The deep key interlocks also exhibit between opposing horizontal block surfaces as positioned between vertical cavities as the block narrows in the negative direction. In addition, there is created a substantially rugged and load resilient interlock between vertical and horizontal complementary surfaces when joined as components of a wall structure.

Notwithstanding the above, it is presently believed that there is a need and a potential commercial market for the building blocks and wall structures according to the present invention. There should be a need and a potential market for such masonry building blocks because they are strong, will support heavy vertical loads and at the same time are relatively light weight. In addition, the masonry building blocks in accordance with the present invention have a high resistance to wind and other lateral forces and can be manufactured and sold at a competitive price. Still further, the weight and cost of such blocks are further reduced by the elliptical vertical passageways extending through the blocks.

BRIEF SUMMARY OF THE INVENTION

In essence, the present invention contemplates a generally rectangular masonry building block and an interlocking wall structure that utilizes such blocks. The building blocks comprise or consist of a pair of opposite longitudinally extending sidewalls, a pair of upper and lower longitudinally extending faces and a pair of opposite vertical end walls. In addition, each block includes at least one and preferably two elliptical passageways diagonally disposed on the longitudinal faces and extending through said blocks in a vertical direction.

In a preferred embodiment of the invention, the masonry block has a generally rectangular configuration and consists of a pair of opposite exterior sides, an upper and a lower longitudinal and generally horizontal face or wall and a pair of opposite vertical end faces transverse of the sides and upper and lower walls or faces. The building blocks each include a pair of side members extending inwardly from the exterior sides or faces and include a top, a bottom and a pair of vertical ends. The side members also include an interior vertically extending rectangular rib.

An intermediate section is disposed between the side members in an abutting relationship therewith and wherein the intermediate section on each side thereof define a pair of generally rectangular shaped vertical recesses with one on each side of the inner section. In addition, the recesses and rectangular ribs are constructed and dimensioned so that the rectangular ribs fit inside the recesses with relatively close tolerances.

The invention will now be described in connection with the following figures wherein like reference numerals have been used to identify like parts.

DESCRIPTION OF THE PREFERRED EMBODIMENTS OF THE INVENTION

The interlocking masonry blocks disclosed herein are of relatively lightweight and can be used by relatively unskilled workers. Such blocks also overcome problems attributed to prior art devices. Further, the blocks are relatively lightweight that makes them easier to handle and at the same time are less likely to breakage. In addition, the blocks in accordance with the present invention provide cavities or passageways for rebars and utility pipes. Still further there are good interlocking surfaces that provide stable attachment to adjoining blocks. Additionally, the use of rebars in the vertical and horizontal passageways and subsequent addition of grout provides strength for resisting damage from earthquakes and wind and storms.

Figure 1:
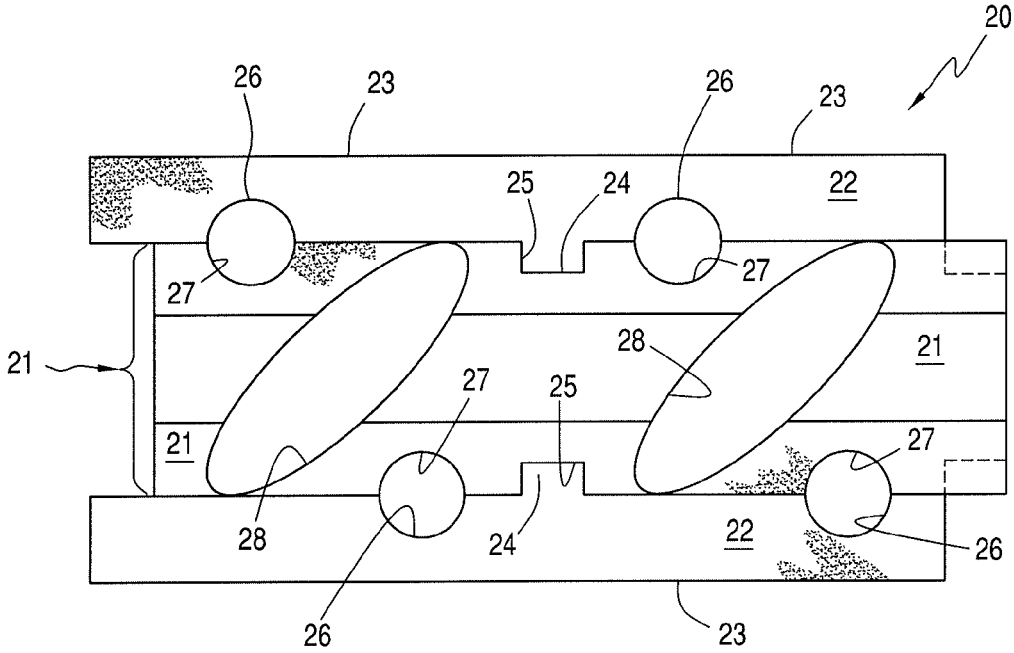
FIG. 1 is a top or plan view of a masonry block in accordance with a preferred embodiment of the invention.
Figure 2:
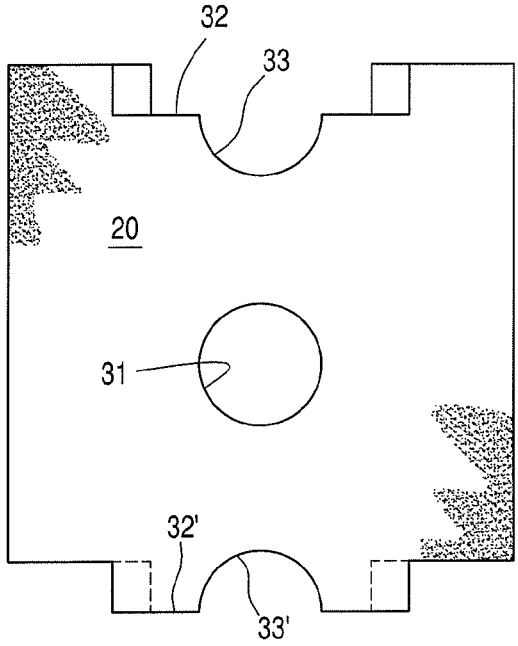
FIG. 2 is an end view of the masonry block shown in FIG. 1.
Figure 3:
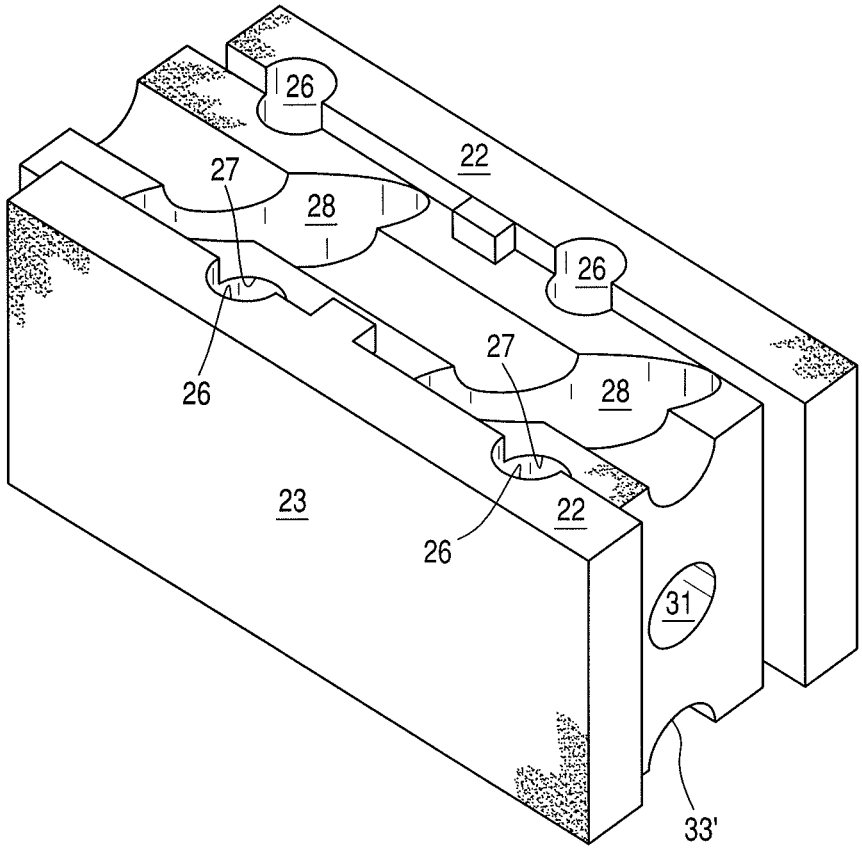
FIG. 3 is an isometric view of the masonry block shown in FIGS. 1 and 2.

Referring now to FIGS. 1-3 an interlocking masonry, cement or cinder block 20 includes a pair of side walls or side members 22. Each of the side members 22 includes a longitudinally extending outer face 23 having a length of about 400 mm and a height of about 200 mm. Each side member has a thickness of about 40 mm and includes an outwardly extending rib 24 that has width of about 30 mm and a thickness of about 15 mm. Each of the side members also include a vertical passageway 26 with a semicircular shape extending from the top to the bottom of the side member. In a preferred embodiment of the invention a pair of semicircular passageways are provided in each side member 22.

The interlocking masonry block 20 also includes a central member 21 with a width of about 120 mm, a length of about 400 mm and the height of about 200 mm, includes a pair of rectangular shaped recesses 25 that are constructed and dimensioned to accommodate one of the ribs 24 with relatively close tolerances. The rectangular recess 25 is formed on each side of the member 21.

The central member 21 also includes a pair of semi-circular pathways 27 on each side thereof that are aligned with the semicircular path ways 26 in the side members 22. With this alignment there are two circular channels extending vertically from top to bottom on each side of the block 20 and when stacked one upon the other extend from the top of a wall to the bottom thereof.

The central portion or member 21 also defines a pair of oval passageways preferably elliptical passageways 28 extending through the central member 21 with a major axis 29 of about 160 mm and a minor axis 29' of about 50 mm. These elliptical passageways are angularly disposed with respect to the longitudinal axis of the block 20 at an angle of between about 30° to 60° and preferably at about 45° as shown FIG. 1.

As illustrated in FIGS. 2 and 3, the block 20 includes a horizontally extending circular passageway 31 having a diameter of about 50 mm extending from one end to the opposite end of the block 20 for one or more rebars and/or a utility conduit. As illustrated the block 20 also includes a pair of horizontal passageways 33, 33' that extend through the length of the block 20 with the pathway 33 in an upper portion immediately below a recess 32 and a second pathway in a lower portion of a lower extension 32'.

When two vertically and horizontally aligned blocks are stacked one on top of the other and aligned, the elliptical passageways and circular passageways extend through both blocks. Then if multiple blocks are placed on top of one another and in alignment the elliptical passageways extend from the top of a wall to a bottom of the wall. Grout can then be injected after placement of rebars and conduits to thereby fill any voids. The same can be done to the horizontal passages in about the center of the blocks and those formed between upper and lower stacked blocks. Grouting is done through the vertical elliptical holes thus filling the vertical elliptical and horizontal circular passageways with grout. No grouting is done in the vertical circular holes.

Figure 4:
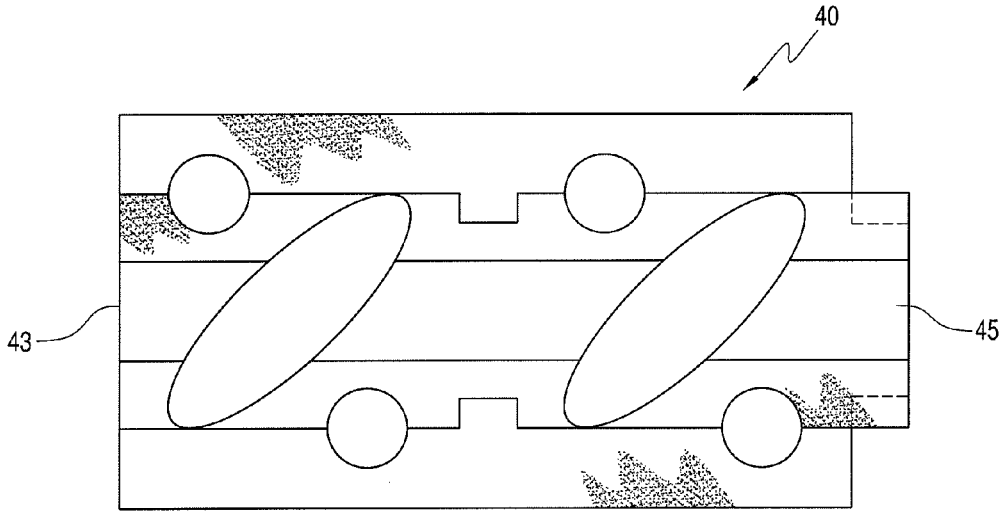
FIG. 4 is a top or plan view illustrating a masonry block for closing a left end of a wall in accordance with the present invention.
Figure 5:
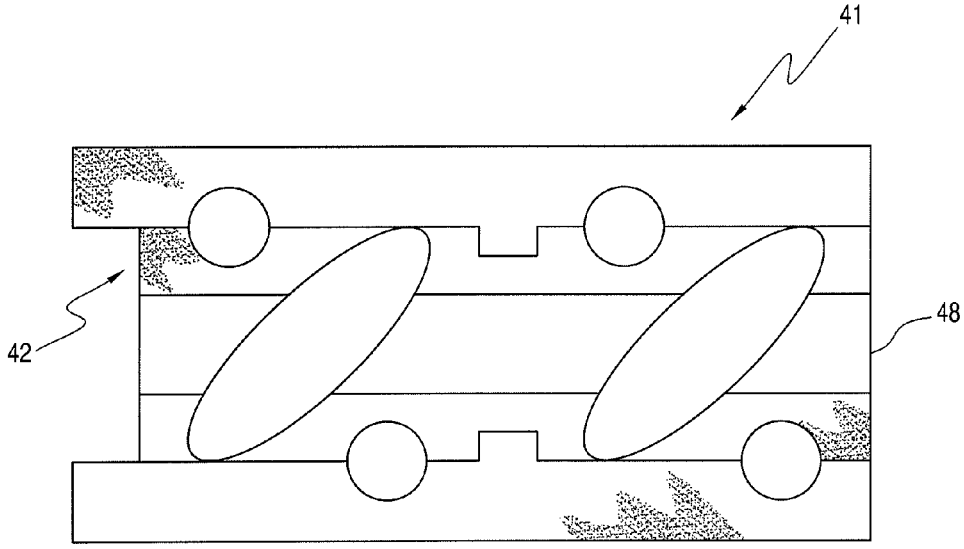
FIG. 5 is a top or plan view illustrating a masonry block for closing a right end of a wall in accordance with the present invention.

FIGS. 4 and 5 illustrate full size end blocks for use at the end of a wall. For example, FIG. 4 shows an end block 40 wherein a recess 42 (FIG. 5) has been eliminated to provide a smooth flat surface 43 (FIG. 4) on the left end of block 40. As shown in FIG. 5, the extension 45 (FIG. 4) has been eliminated to provide a smooth flat end surface 48 for the right side of a wall.

Figure 6:
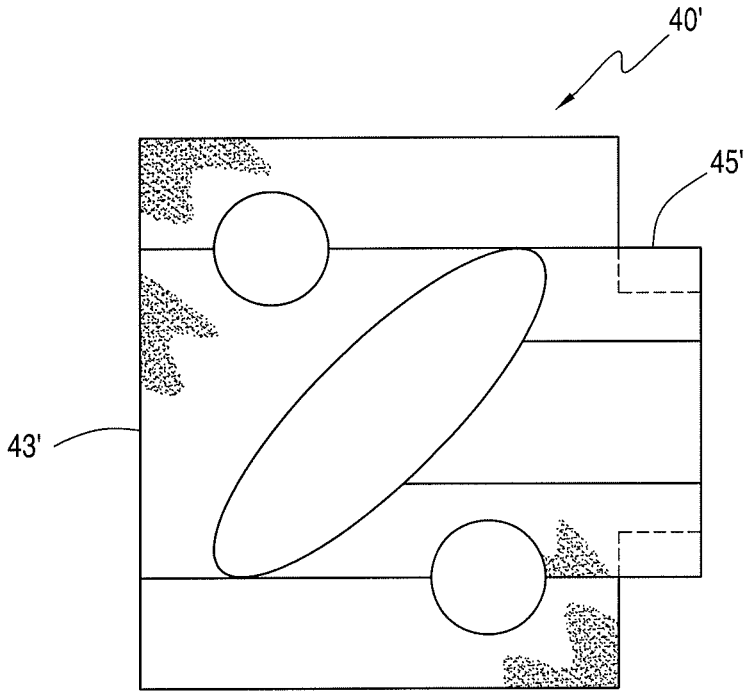
FIG. 6 is a top or plan view illustrating a half masonry block for closing a left end of a wall in accordance with the present invention.
Figure 7:
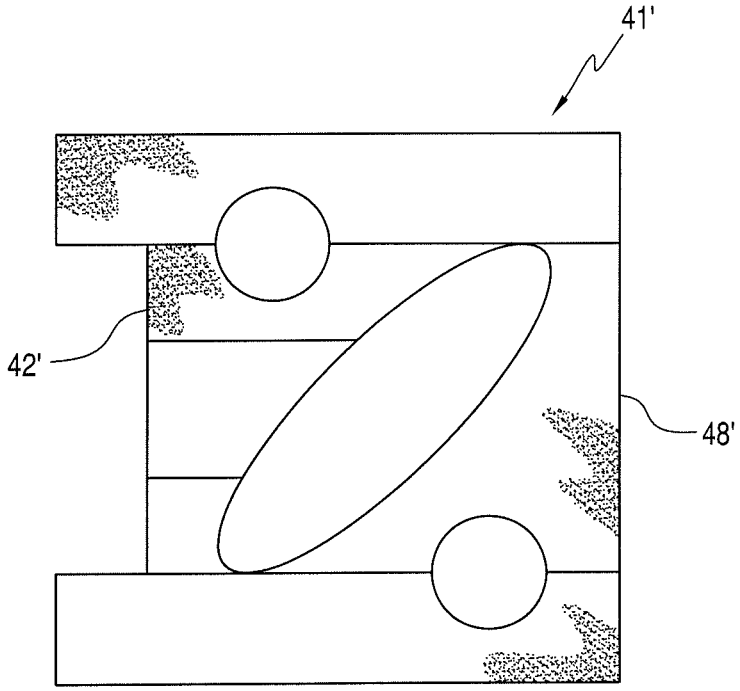
FIG. 7 is a top or plan view illustrating a half masonry block for closing a right end of a wall in accordance with the present invention.

FIGS. 6 and 7 are similar to FIGS. 4 and 5 but show half blocks 40', 41' with a smooth flat surface 43' (FIG. 6) on the left end and a flat surface 48' (FIG. 7) on the right end of the block respectively. These half end blocks are needed to fill the space at the end of a wall wherein alternate staggered rows in a vertical direction leave a half block space or void at the end of a row. The half blocks each include a single vertical elliptical passageway 46 and a pair of circular vertical passageways 47.

Figure 8:
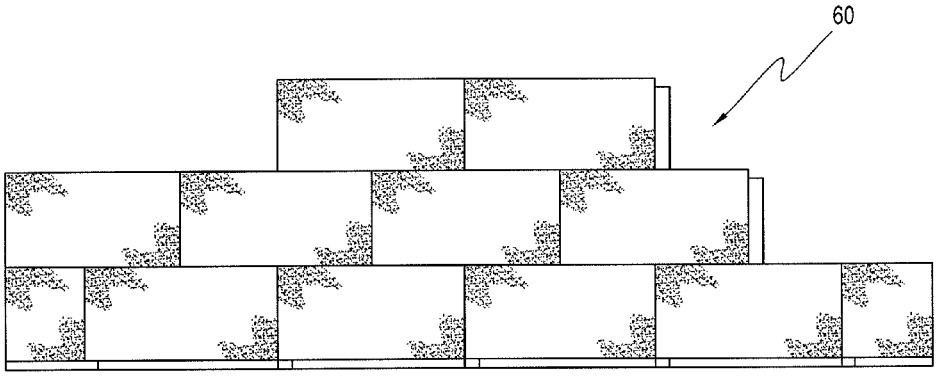
FIG. 8 is a front elevational view of a wall under construction using masonry blocks in accordance with the present invention.
Figure 9:
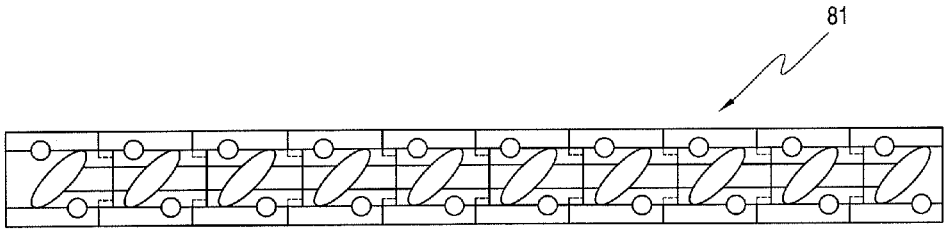
FIG. 9 is a top or plan view of a wall structure incorporating blocks in accordance with the present invention and wherein the ends are staggered as it increases in height.

As illustrated in FIG. 8 a partial wall 60 (FIG. 8) and completed wall 81 (FIG. 9) illustrate staggered horizontal rows with a half end block at the left end of bottom row or layer of the wall and a whole left end block at the end of the second horizontal row or layer. As shown in FIG. 8, a right hand half end block is shown at the bottom row of the blocks in the wall.

Figure 10:
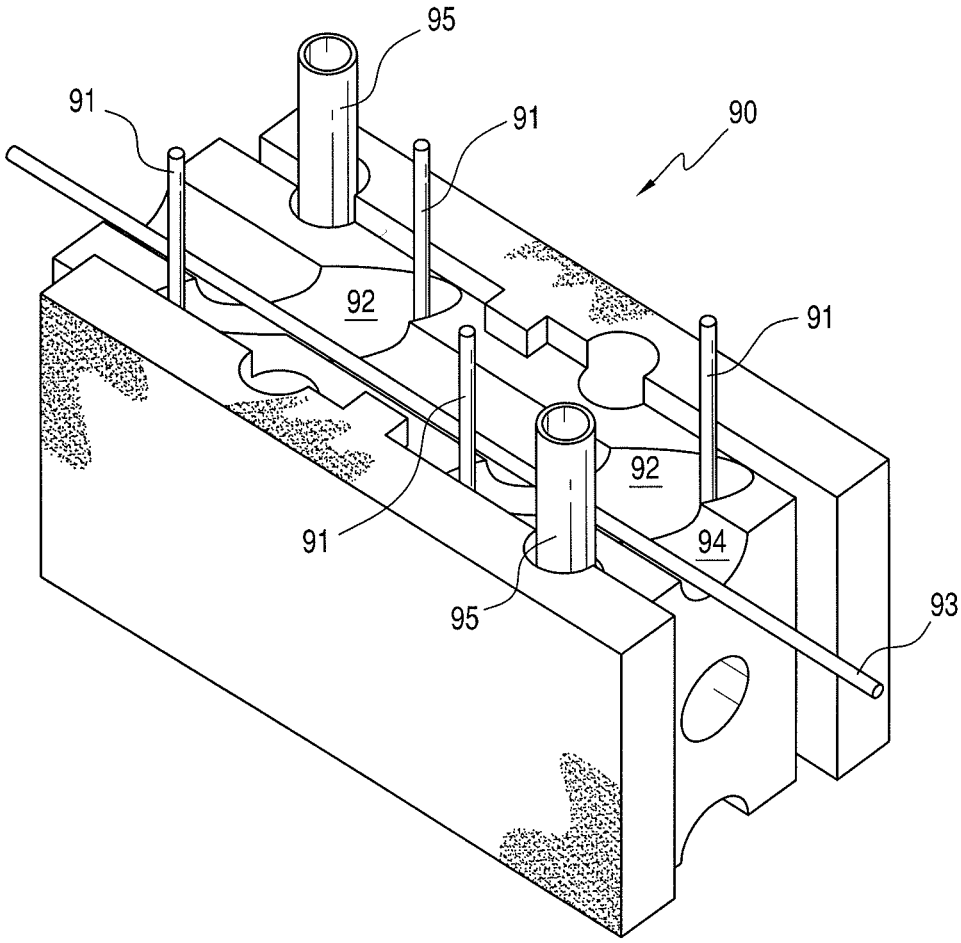
FIG. 10 is an isometric view of a masonry block in accordance with the preferred embodiment of the invention and including rebars in the vertical elliptical passageways and in the horizontal semicircular passageways and conduits or utility pipes in the vertical circular passageways between the side member and intermediate section.

FIG. 10 illustrates a block 90 including four vertical rebars 91 extending through elliptical passageways 92 at opposite ends thereof and a single horizontal rebar 93 extending on top of a horizontally extending recess 94. This circular recess will have a complementary recess in a vertically adjacent block (not shown). After installation of the rebars, the voids can then be filled with grout. As illustrated a pair of vertical extending utility conduits 95 between side members and the central portion 96 are provided for electrical wiring, telephone lines and the like.

While the invention has been disclosed in connection with its preferred embodiments it should be recognized that changes and modifications may be made therein without departing from the scope of the claims.

What is claimed is:

1. A rectangular shaped masonry building block comprising:

a pair of opposite exterior sides and upper and lower longitudinally extending horizontal faces or walls and a pair of opposite vertical ends transverse of said sides and said longitudinally extending upper and lower faces; and wherein said building blocks include a pair of side members and wherein each of said side members includes a vertically extending exterior rectangular rib on an inner side thereof;

a generally rectangular intermediate section disposed between said side members in an abutting relationship therewith and wherein said intermediate section defines a rectangular shaped vertical recess between said side member and a rectangular extension extending below a bottom portion of said side members;

wherein said rectangular extension and said vertical recess are constructed and dimensioned so that said vertically extending exterior rectangular rib fits loosely but closely within said recess of an adjacent block;

said intermediate section including a pair of elliptical shaped vertical passageways diagonally disposed with respect to said upper and lower faces of said blocks and extending therethrough at an angle of between 30 and 60 degrees;

wherein said elliptical shaped vertical passageways are adapted to receive rebars and/or grout extending through said elliptical shaped passageways; and in which said intermediate section includes a pair of semicircular shaped vertical passageways on each side thereof and wherein each of said side members includes a pair of semicircular shaped vertical passageways that correspond and are aligned with said semicircular passageways on said side members so that said block includes four circular shaped vertical passageways extending therethrough.

2. A generally rectangular shaped masonry building block according to claim 1, in which said intermediate section together with said side members provide a vertically disposed rectangular shaped recess in one of said end faces between said side members; and a vertically disposed rectangular extension at an opposite vertical end face extending inwardly and beyond said side members and wherein said recess and said extensions are constructed and dimensioned to fit with said extension fitting into a recess in an adjacent block with a loose but closely fit tolerance.

3. An interlocking masonry wall structure including a course of interlocking masonry blocks wherein said blocks are interlocked at adjacent ends horizontally and two vertically adjacent blocks and said blocks are each constructed and dimensioned as follows:

a pair of opposite exterior sides and upper and lower longitudinally extending horizontal faces or walls and a pair of opposite vertical ends transverse of said sides and said longitudinally extending upper and lower faces; and wherein said building blocks include a pair of side members and wherein each of said side members includes a vertically extending exterior rectangular rib on an inner side thereof;

a generally rectangular intermediate section disposed between said side members in an abutting relationship therewith and wherein said intermediate section defines a rectangular shaped vertical recess between said side member and a rectangular extension extending below a bottom portion of said side members;

wherein said rectangular extension and said vertical recess are constructed and dimensioned so that said vertically extending exterior rectangular rib fits loosely but closely within a rectangular shaped vertical recess of an intermediate section of an adjacent block; and said intermediate section including a pair of elliptical shaped vertical passageways diagonally disposed with respect to said upper and lower faces of said blocks and extending therethrough at an angle of about 45°; and in which each of said side members define a longitudinally extending outer face having a length of about 400 mms and a height of about 200 mms and in which said vertically extending exterior rectangular rib has a width of about 30 mms and a thickness of about 15 mms; and a vertically disposed rectangular extension at a vertical end face extending inwardly and beyond said side members and wherein a vertically disposed rectangular shaped recess at an opposite vertical end face are constructed and dimensioned to fit with said extension fitting into a recess in an adjacent block with a loose but closely fit tolerance; and in which said intermediate section including a pair of semicircular shaped vertical passageways on each side thereof and wherein each of said side members includes a pair of semicircular shaped vertical passageways that correspond and are aligned with said semicircular passageways on said side members so that said block includes four circular shaped vertical passageways extending therethrough.

4. A rectangular shaped masonry building block consisting of:

a pair of opposite exterior sides, an upper and lower longitudinal horizontal faces and a pair of opposite vertical ends transverse of said sides and said longitudinally extending upper and lower faces; and wherein said building block further consisting of a pair of side members and wherein each of said side members consists of a vertically extending rectangular rib on an inner side thereof;

a generally rectangular intermediate section disposed between said side members in an abutting relationship therewith and wherein said intermediate section defines a rectangular shaped vertical recess between said side member and a rectangular shaped extension extending below a bottom portion of said side members; and wherein said vertically extending rectangular rib and said vertical recess are constructed and dimensioned to fit loosely but closely together; and said intermediate section including a pair of elliptically shaped vertical passageways diagonally disposed at an angle of between 30° and 60° with respect to said upper and said lower horizontal faces and extending therethrough; and, wherein said elliptical shaped vertical passageways are adapted to receive rebars and/or grout extending through said elliptical shaped passageways and wherein said elliptically shaped vertical passageways are adapted to receive conduits and utility pipes extending through said elliptically shaped passageways.

5. A generally rectangular shaped masonry building block according to claim 4, in which said intermediate section together with said side members provide a vertically disposed rectangular shaped recess in said intermediate section between said side members; and a vertically disposed rectangular extension at an opposite vertical end face extending outwardly beyond said side members and wherein said recess in one vertical end and said extension in said opposite vertical end of vertically adjacent blocks are constructed and dimensioned to fit together with a loose but close fit.

6. A rectangular shaped masonry building block according to claim 5, in which said elliptical passageways are disposed at an angle of about 45° with respect to said upper and lower horizontal faces and extending therethrough.

7. A rectangular shaped masonry building block according to claim 6, in which said intermediate section includes a pair of semicircular shaped vertical passageways on each side thereof and wherein each of said side members includes a pair of semicircular shaped vertical passageways that correspond and are aligned with said semicircular passageways on said side members so that said block includes four circular shaped vertical passageways extending therethrough.

* * * * *